US011253827B2

(12) United States Patent
Hawrylenko

(10) Patent No.: US 11,253,827 B2
(45) Date of Patent: Feb. 22, 2022

(54) SHAKER

(71) Applicant: Infors AG, Bottmingen (CH)

(72) Inventor: Alexander Hawrylenko, Bottmingen (CH)

(73) Assignee: INFORS AG, Bottmingen (CH)

( * ) Notice: Subject to any disclaimer, the term of this patent is extended or adjusted under 35 U.S.C. 154(b) by 528 days.

(21) Appl. No.: 16/177,521

(22) Filed: Nov. 1, 2018

(65) Prior Publication Data

US 2019/0126221 A1 May 2, 2019

(30) Foreign Application Priority Data

Nov. 2, 2017 (EP) ..... 17199729

(51) Int. Cl.
*B01F 11/00* (2006.01)

(52) U.S. Cl.
CPC ..... *B01F 11/0014* (2013.01); *B01F 11/0008* (2013.01); *B01F 11/0031* (2013.01); *B01F 2215/0481* (2013.01)

(58) Field of Classification Search
CPC ..... B01F 11/0014; B01F 11/0008; B01F 11/0031
See application file for complete search history.

(56) References Cited

U.S. PATENT DOCUMENTS 3,481,468 A * 12/1969 Tonjes ..... B06B 1/167 209/237
4,125,335 A 11/1978 Blume et al.
4,134,689 A 1/1979 Ahrenskou-Sorensen
4,202,634 A 5/1980 Kraft et al.
4,477,434 A 10/1984 Kosaka
5,558,437 A 9/1996 Rode
5,567,050 A 10/1996 Zlobinsky et al.
6,106,143 A * 8/2000 Nickel ..... B01F 11/0014 366/128

FOREIGN PATENT DOCUMENTS

| | | | |
|---|---|---|---|
| DE | 1816710 | A1 | 6/1970 |
| DE | 2819833 | A1 | 11/1978 |
| DE | 3319575 | A1 | 12/1983 |
| DE | 3319574 | C2 | 8/1987 |
| DE | 19814013 | C | 7/1999 |
| DE | 10239786 | A1 | 3/2004 |
| DE | 102009043354 | A1 | 3/2011 |
| EP | 1393797 | A2 | 3/2004 |
| EP | 1854533 | A1 | 11/2007 |
| EP | 2301679 | A2 | 3/2011 |

OTHER PUBLICATIONS

European Search Report for Serial No. EP 17 19 9729 dated May 14, 2018.

* cited by examiner

*Primary Examiner* — Anshu Bhatia
(74) *Attorney, Agent, or Firm* — McCormick, Paulding & Huber PLLC

(57) ABSTRACT

Shaker comprising a frame, a tray for receiving one or more samples and a drive for the tray, in which a tray shaft is mounted eccentrically in a drivable hollow shaft. The tray shaft is fixedly connected to the tray and secured against rotation relative to the frame.

19 Claims, 2 Drawing Sheets

SHAKER

CROSS REFERENCE TO RELATED APPLICATIONS

This application claims foreign priority benefits under U.S.C § 119 to European patent application EP 17 199 729.9, filed on Nov. 2, 2017, the content of which is hereby incorporated by reference in its entirety.

FIELD OF THE INVENTION

The invention concerns a shaker, in particular a laboratory shaker, in particular for shaking and/or mixing samples containing liquids.

BACKGROUND ART

Shakers are used to shake and/or mix liquids, e.g. cell cultures, biofuels or blood samples, in vessels. The shaken unit often comprises a tray on which the vessels, e.g. Erlenmeyer flasks, test tubes or other ampoules containing the samples, are placed. On the one hand, a high shaking frequency is desirable. On the other hand, liquid can be spilled or sprayed on the tray during the shaking process, which can also contaminate other components such as a shaker drive. With conventional shakers, such contamination affects numerous components, so that the necessary cleaning is a considerable effort.

SUMMARY

The problem is therefore to design a shaker with a high shaking frequency which is designed in such a way that the cleaning effort in case of contamination is as low as possible.

This problem is solved by the device of claim 1. Accordingly, the shaker comprises a frame, a tray for receiving one or more samples and a drive for the tray in which a tray shaft is mounted eccentrically in a drivable hollow shaft. The tray shaft is fixedly connected to the tray and secured against rotation relative to the frame.

The frame is preferably a rigid structure comprising one or more elements that allows the shaker to be placed or fixed on a work surface or installed in another device, e.g. an incubator for cell cultures or microbial applications. The tray is preferably a support whose surface area is larger than its height, e.g. a plate. Typically, the samples are liquids, e.g. cell cultures, biofuels or blood samples, and are contained in vessels, e.g. Erlenmeyer flasks, test tubes or other ampoules. The tray preferably includes mounting options for the vessels. The drive for the tray preferably includes a motor, in particular an electric motor, and a mechanism to drive the shafts.

The hollow shaft is mounted on the frame, preferably with a ball bearing, and contains a cavity in which the tray shaft is located. In a preferred embodiment, the tray shaft is mounted in the hollow shaft with a needle bearing and/or a ball bearing. The bearing enables low-friction rotation and high shaking frequencies in a compact design. The rotation axes of the hollow shaft and the tray shaft are parallel to each other, but have a spatial offset, i.e. an eccentric position. This eccentricity determines the amplitude of the circular shaking movement of the tray. In a preferred embodiment, the eccentricity of the tray shaft in relation to the hollow shaft is at most 25 mm and in particular 1.5 mm.

The tray shaft is fixedly connected to the tray during shaker operation, the tray shaft and the tray are secured against rotation relative to each other. The connection is preferably designed in such a way that the tray can be removed from the tray shaft by the user, e.g. for cleaning. In a preferred embodiment, the tray shaft engages in the centre of gravity or in the geometric centre of the tray in order not to load the connection and the needle bearing with an unbalance.

The shaker advantageously includes a cover between the tray and the drive. The cover is preferably sealed against the hollow shaft and preferably includes a trough. It may be made of metal, plastic, glass or plexiglass, for example, it may comprise one or more elements and partially or completely enclose the tray. In a coordinate system in which the tray is in the xy-plane at $z=0$ and the tray shaft forms part of the negative z-axis, the trough would comprise a sheet at $z<0$ which extends beyond the dimensions of the tray in the xy-plane, and the trough would form an edge around the tray up to a height $z>0$. The trough may also be extended by a lid at a height $z>0$, such that it may be designed as a container around the entire tray holding the sample vessels.

The cover prevents contamination of the actuator with liquids or solids, for example if a vessel with a sample falls over and liquid is spilled or spattered. Preferably the cover may also be removed by the user. This facilitates cleaning of the shaker, which is essential for further use, as continued contamination of the shaker may contaminate other samples. It is advantageous that only the tray shaft is located between the tray and the cover, so that only the tray, the tray shaft and the cover, but not other drive elements, have to be cleaned if contaminated.

To prevent the tray shaft and the tray from rotating with the hollow shaft when the circular shaking movement is carried out, the tray shaft is secured against rotation relative to the frame. A preferred embodiment of securing against rotation is described below. Instead of the conventional securing of the tray against rotation, the present invention secures the tray shaft against rotation relative to the frame. This allows the drive and the securing mechanism to be located under the cover. This makes it easier to clean the shaker when it is contaminated, and higher shaking frequencies can also be achieved, resulting in better mixing of the samples. In a preferred version, the shaking frequency of the tray due to the drive is at least 1000 rpm, in particular at least 1400 rpm.

The securing of the tray shaft against rotation relative to the frame is preferably achieved with a connecting element which is attached to the tray shaft in a non-rotatable manner, in particular where the connecting element contains a coupling rod. In a preferred embodiment, the shaker comprises a second hollow shaft mounted on the frame and a second tray shaft mounted eccentrically in the second hollow shaft and also secured against rotation on the connecting element. The second tray shaft has the same eccentric position relative to the second hollow shaft as the tray shaft has relative to the hollow shaft, so the structure of the shafts at both ends of the connecting element is the same in this embodiment.

In one embodiment, the hollow shaft has a belt pulley for drive via a toothed belt. The toothed belt ensures the transmission of rotation from a shaft of the motor to the hollow shaft. The shaking frequency can preferably be defined by the user. Another belt pulley with the same diameter as the belt pulley on the hollow shaft is also attached to the second hollow shaft for drive by the toothed belt. This ensures that the hollow shaft and the second hollow shaft rotate at the same frequency and in phase. In another embodiment, the shaker comprises a gear transmission for driving the hollow shaft. The hollow shaft and preferably the second hollow shaft each have at least one gear wheel.

Advantageously, the connecting element comprises an elastic element for compensating changes in distance between its two fixing points on the tray shaft and the second tray shaft. Such distance changes may be caused by thermal expansion or inaccuracies in manufacturing, or they may be caused by a slightly out-of-phase rotation of the hollow shaft and the second hollow shaft. The elastic element therefore enables optimum operation of the shaker even with mechanical inaccuracies and is therefore important for smooth operation over a longer period of time. In one embodiment, the elastic element is a spring, in particular a leaf spring. Other embodiments of the elastic element, such as a piece of hard rubber, are conceivable.

In an advantageous embodiment, at least one counterweight on the hollow shaft contributes to the smooth operation of the shaker by balancing an unbalance caused by eccentric mass distribution. Preferably the one or more counterweights are located on the side of the cover facing the drive so as not to be affected by possible contamination. In one embodiment, other shafts are also balanced with one or more counterweights, e.g. the tray shaft. The preferably at least one counterweight protects the bearings and enables continuous operation of the shaker with high shaking frequencies.

BRIEF DESCRIPTION OF THE DRAWINGS

Further embodiments, advantages and applications of the invention result from the dependent claims and from the following description of the figures.

DETAILED DESCRIPTION

Figure 1:
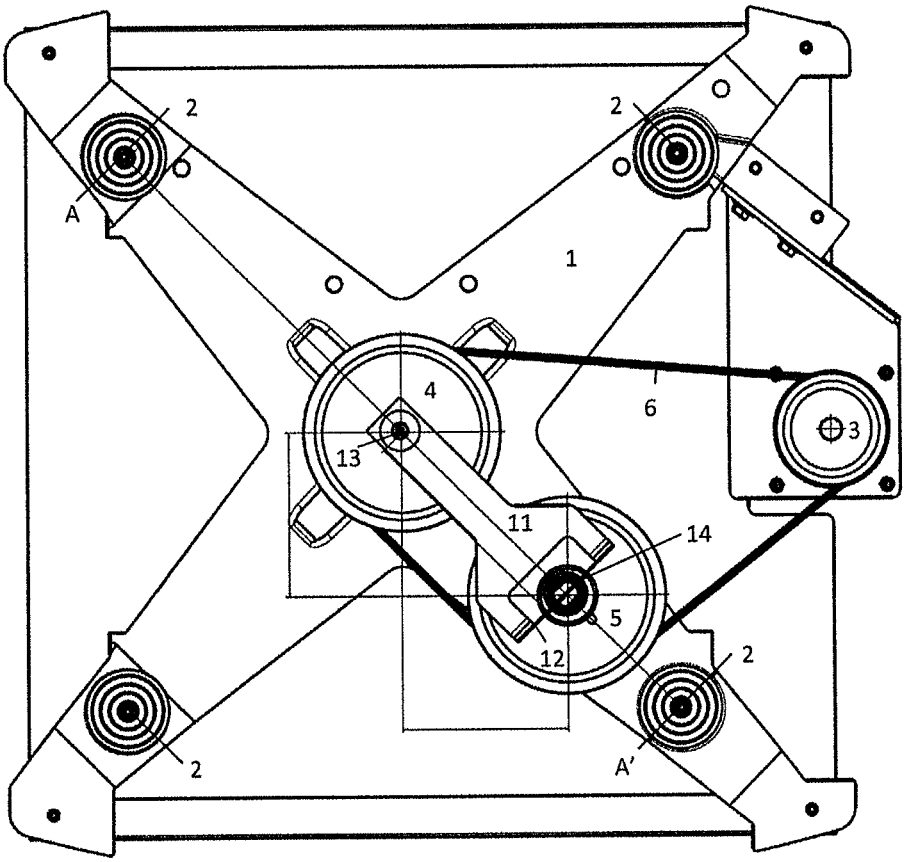
FIG. 1 shows a view from below of a shaker according to an embodiment of the invention with frame, drive and eccentrically mounted connecting element.
Figure 2:
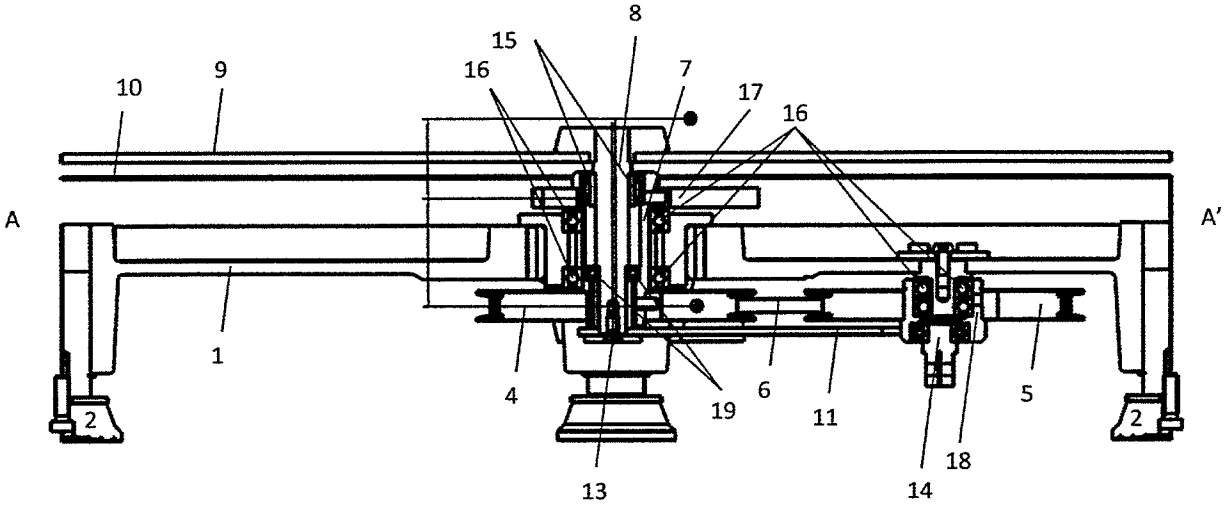
FIG. 2 shows a vertical section through the shaker of FIG. 1 along the diagonal A-A', which goes through the shafts of the two larger pulleys.

A preferred embodiment of the invention is shown in FIG. 1 and FIG. 2. FIG. 1 shows a view from below of a shaker according to an embodiment of the invention with frame 1, drive 3-6 and eccentrically mounted connecting element 11. The shaker comprises a frame 1 made of metal or plastic, for example, which stands on four feet 2.

Frame 1 is fitted with a motor, e.g. an electric motor, which drives a pulley 3. Two further pulleys 4 and 5 are driven via a toothed belt 6, which prevents slippage. These pulleys are mounted on shafts which are described in more detail below.

FIG. 2 shows a vertical section through the shaker along the diagonal A-A' passing through the shafts of the two pulleys 4 and 5. The first belt pulley 4 driven by the toothed belt 6 is mounted on a hollow shaft 7, which is rotatably mounted on the frame 1 via ball bearings 16. The second belt pulley 5, driven by the toothed belt 6, is mounted on a second hollow shaft 18, which is also preferably mounted on the frame 1 so that it can rotate via ball bearings 16.

Inside the hollow shaft 7 there is a tray shaft 8, the rotation axis of which is parallel to that of the hollow shaft 7. The tray shaft 8 is mounted eccentrically in the hollow shaft 7, e.g. with an offset of the rotation axes of 1.5 mm, which leads to a circular movement of the tray shaft 8, in the example with a total amplitude of 3 mm. Needle bearings 15 and/or ball bearings 19 are used for the low-friction bearing of the tray shaft 8 in the hollow shaft 7.

A tray 9 is firmly connected to the tray shaft 8 and serves as a platform or holder for sample vessels to be shaken. For this purpose, the tray 9 can be equipped with a sample holder or it may have mounting options for Erlenmeyer flasks, test tubes or other ampoules. The tray 9 can be removed for cleaning purposes.

In addition, the tray shaft 8 is firmly connected to a coupling rod 11, whereby the attachment 13 of the coupling rod 11 to the tray shaft 8 cannot be rotated. The coupling rod serves as a connecting element to a second tray shaft 14. The second tray shaft 14 is eccentrically mounted in the second hollow shaft 18, analogously and with the same eccentricity as in the arrangement of tray shaft 8 and hollow shaft 7. The second tray shaft 14 is also secured to the coupling rod 11 so that both the tray shaft 8 and the second tray shaft 14 are secured against rotation relative to the frame 1. The coupling rod 11 is preferably a sheet metal welded to the tray shaft 8 and the second tray shaft 14.

The two belt pulleys 4 and 5 on the hollow shaft 7 and the second hollow shaft 18 run in phase due to the drive through the toothed belt 6. As a result, although the tray shaft 8 and the tray 9 connected to it rotate relative to the hollow shaft 7, they retain their spatial orientation in relation to the frame 1 while undergoing a circular deflection.

The connection of the coupling rod 11 with the second tray shaft 14 is ideally made by a leaf spring 12, which as an elastic element can compensate for distance changes e.g. due to thermal expansion or inaccurate production.

Between tray 9 and frame 1 including the drive mechanism, there is a cover 10 which is firmly connected to frame 1 and sealed at the passage of the tray shaft 8. The cover 10 protects the drive mechanism from contamination by solids and liquids, e.g. in the event that a sample vessel on the tray 9 tips over and liquid is spilled of spattered. The cover 10 is preferably designed as a trough which is sealed against solids and liquids on the hollow shaft 7. Inside the trough, there is only the tray 9, a part of the tray shaft 8 and the samples in the vessels on the tray 9. This means that only these elements have to be cleaned if they are contaminated, while the drive mechanism, which would be difficult to clean, remains clean.

In addition, at least one counterweight 17 is attached to the hollow shaft 7, which compensates for an unbalance caused by the eccentric mass distribution of tray 9, sample holders, samples and tray shaft 8. In addition, a counterweight can also be attached to the tray shaft 8 to achieve dynamic balancing of the system. Balancing the unbalance protects the bearings, reduces noise emissions and extends the service life of the drive.

The described design of the shaker makes it possible to achieve high shaking frequencies of more than 1000 rpm and in particular of 1000 to 1600 rpm or more due to the drive.

While in the present application preferred embodiments of the invention are described, it should be noted that the invention is not limited to these and can also be executed in another way within the scope of the following claims.

The invention claimed is:

1. A shaker comprising a frame, a tray for receiving one or more samples, a drive for the tray, in which a tray shaft is mounted eccentrically in a hollow shaft, the hollow shaft is drivable by the drive, a connecting element which is fastened to the tray shaft so as to be non-rotatable in order to secure the tray shaft against rotation relative to the frame, a second hollow shaft which is mounted on the frame, and a second tray shaft which is mounted eccentrically in the second hollow shaft and is secured to the connecting element in a non-rotatable manner, the second tray shaft having the same eccentric position relative to the second hollow shaft as the tray shaft has relative to the hollow shaft, wherein the tray shaft is fixedly connected to the tray and secured against rotation relative to the frame.

2. The shaker according to claim 1, comprising a cover between the tray and the drive.

3. The shaker according to claim 2, wherein the cover is sealed against the hollow shaft to prevent contamination of the drive.

4. The shaker according to claim 2, wherein the cover comprises a trough.

5. The shaker according to claim 2, whereby only the tray shaft is located between the tray and the cover.

6. The shaker according to claim 1, wherein the connecting element contains a coupling rod.

7. The shaker according to claim 1, wherein the connecting element comprises an elastic element for compensating for distance changes between its two attachment points at the tray shaft and the second tray shaft.

8. The shaker according to claim 7, wherein the elastic element is a spring, in particular a leaf spring.

9. The shaker according to claim 1, the hollow shaft having a belt pulley for the drive via a toothed belt.

10. The shaker according to claim 9, wherein another belt pulley is fastened to the second hollow shaft for being driven by the toothed belt.

11. The shaker according to claim 1, comprising a gear transmission for driving the hollow shaft.

12. The shaker according to claim 11, wherein the gear transmission also drives the second hollow shaft.

13. The shaker according to claim 1, comprising at least one counterweight on the hollow shaft for balancing an unbalance occurring due to eccentric mass distribution.

14. The shaker according to claim 13, wherein the at least one counterweight is located on the side of a cover facing the drive.

15. The shaker according to claim 13, comprising another counterweight on the tray shaft for balancing an unbalance occurring due to eccentric mass distribution.

16. The shaker according to claim 1, wherein the eccentricity of the tray shaft relative to the hollow shaft is at most 25 mm.

17. The shaker according to claim 1, wherein the eccentricity of the tray shaft relative to the hollow shaft is 1.5 mm.

18. The shaker according to claim 1, wherein a shaking frequency of the tray due to the drive is at least 1000 rpm.

19. The shaker according to claim 1, wherein a shaking frequency of the tray due to the drive is at least 1400 rpm.

* * * * *